US010184480B2

(12) United States Patent
Humburg et al.

(10) Patent No.: US 10,184,480 B2
(45) Date of Patent: Jan. 22, 2019

(54) SIDE CHANNEL BLOWER, ESPECIALLY FOR A VEHICLE HEATER

(71) Applicant: Eberspächer Climate Control Systems GmbH & Co. KG, Esslingen (DE)

(72) Inventors: Michael Humburg, Göppingen (DE); Hermann Eppler, Balingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 203 days.

(21) Appl. No.: 14/956,533

(22) Filed: Dec. 2, 2015

(65) Prior Publication Data

US 2016/0160865 A1 Jun. 9, 2016

(30) Foreign Application Priority Data

Dec. 5, 2014 (DE) ..... 10 2014 224 954

(51) Int. Cl.
*F04D 25/16* (2006.01)
*F04D 25/12* (2006.01)
(Continued)

(52) U.S. Cl.
CPC ..... *F04D 25/12* (2013.01); *F04D 17/08* (2013.01); *F04D 23/008* (2013.01); *F04D 25/06* (2013.01);
(Continued)

(58) Field of Classification Search
CPC ..... F04D 25/06; F04D 25/08; F04D 25/166; F04D 29/4206; F04D 29/4226;
(Continued)

(56) References Cited

U.S. PATENT DOCUMENTS 2,983,432 A * 5/1961 Tupper ..... A47L 5/22 15/327.1
3,120,340 A * 2/1964 Strumpell ..... F04D 25/166 415/127
(Continued)

FOREIGN PATENT DOCUMENTS

DE 20 01 395 A1 7/1971
DE 197 56 026 A1 7/1999
(Continued)

OTHER PUBLICATIONS

European Search Report dated Mar. 22, 2016.
German Examination Report dated Feb. 4, 2016.

*Primary Examiner* — Charles Freay
*Assistant Examiner* — Thomas Fink
(74) *Attorney, Agent, or Firm* — McGlew and Tuttle, P.C.

(57) ABSTRACT

A side channel blower includes a housing (10) a motor (16) with a motor shaft that rotates about a motor axis. A first blower housing area (30) has a first delivery channel (34) with an inlet (36) and outlet (38) and is open towards a first axial side (32) and surrounds the motor axis. A first delivery wheel (46) covers the first delivery channel (34) and is carried at a first end area (44) of a motor shaft (20). A second blower housing area (52) has a second delivery channel (56) with an inlet (58) and with an outlet (60) and is open towards a second axial side (54) and surrounds the motor axis. A second delivery wheel (68) is located opposite the second axial side (54) and covers the second delivery channel (56) and is carried at a second end area (64) of the motor shaft (20).

13 Claims, 3 Drawing Sheets

(51) Int. Cl.

| | |
|---|---|
| ***F04D 23/00*** | (2006.01) |
| ***F04D 17/08*** | (2006.01) |
| ***F04D 25/06*** | (2006.01) |
| ***F04D 29/053*** | (2006.01) |
| ***F04D 29/28*** | (2006.01) |
| ***F04D 29/42*** | (2006.01) |
| ***F04D 29/66*** | (2006.01) |

(52) U.S. Cl.
CPC ..... *F04D 25/166* (2013.01); *F04D 29/053* (2013.01); *F04D 29/281* (2013.01); *F04D 29/4206* (2013.01); *F04D 29/663* (2013.01)

(58) Field of Classification Search
CPC ..... F04D 17/08; F04D 23/008; F04D 29/663; F04D 29/665–29/667
See application file for complete search history.

(56) References Cited

U.S. PATENT DOCUMENTS 3,375,970 A * 4/1968 Zoehfeld ..... F04D 23/008 415/119
4,171,190 A * 10/1979 Hudson ..... H02K 5/24 248/638
4,483,656 A 11/1984 Abe et al.
4,719,757 A * 1/1988 Nakazawa ..... F01D 17/18 29/889.22
4,893,995 A * 1/1990 Hufstader ..... F04D 25/082 415/169.1
4,902,203 A * 2/1990 Sager ..... F04D 29/424 415/176
4,929,149 A * 5/1990 Greenspan ..... F04D 17/162 415/93
5,388,956 A * 2/1995 Pla ..... F04D 25/166 415/1
5,403,163 A * 4/1995 Murphy ..... F16M 1/00 248/638
5,692,054 A * 11/1997 Parrella ..... F04D 29/665 381/71.3
6,158,978 A * 12/2000 Norbury, Jr. ..... F04D 25/082 248/638
6,789,999 B2 * 9/2004 Bikos ..... B60H 1/00471 415/206
8,876,493 B2 * 11/2014 Kawamura ..... H02K 16/02 310/114
2003/0228219 A1 * 12/2003 Mikami ..... F04D 25/082 415/213.1
2004/0115039 A1 * 6/2004 Botros ..... F04D 25/166 415/101
2005/0103339 A1 * 5/2005 Daly ..... A61M 16/0057 128/204.18
2005/0237717 A1 * 10/2005 Babb ..... G06F 1/206 361/697
2008/0000351 A1 * 1/2008 Celik ..... F04D 25/166 95/95
2008/0003094 A1 * 1/2008 Celik ..... B01D 53/0446 415/1
2015/0247506 A1 * 9/2015 Lee ..... F04D 17/105 417/366
2016/0153460 A1 * 6/2016 Okabe ..... F04D 25/082 417/423.1
2017/0051749 A1 * 2/2017 Cho ..... F04D 25/08

FOREIGN PATENT DOCUMENTS

DE 20 2013 005423 U1 7/2013
JP S61 261699 A 11/1986

* cited by examiner

SIDE CHANNEL BLOWER, ESPECIALLY FOR A VEHICLE HEATER

CROSS REFERENCE TO RELATED APPLICATIONS

This application claims the benefit of priority under 35 U.S.C. § 119 of German Patent Application 10 2014 224 954.6 filed Dec. 5, 2014, the entire contents of which are incorporated herein by reference.

FIELD OF THE INVENTION

The present invention pertains to a side channel blower, which can be used, for example, in a vehicle heater in order to deliver the combustion air necessary for the combustion with fuel from the area surrounding the vehicle heater into a combustion chamber.

BACKGROUND OF THE INVENTION

Such a side channel blower comprises a blower motor with a motor shaft, at the end area of which a delivery wheel is carried. The delivery wheel covers an axially open delivery channel surrounding the motor shaft and the axis of rotation thereof in a ring-shaped manner. The air to be delivered can enter the delivery channel in a delivering medium inlet and can exit the delivery channel in a delivering medium outlet provided, in general, close to an interruptor area.

To change the heat output of a vehicle heater, it is necessary to correspondingly vary the quantity of the fuel to be burned and of the combustion air. The conveying output of the combustion air is adapted, in general, by varying the speed of rotation of the blower motor and thus also of the delivery wheel being driven by same for rotation. It is, in general, necessary, especially at heat output levels with high heat output, to operate the delivery wheel at high speeds of rotation of up to 10,000 revolutions per minute. Since both the power drain, i.e., for example, the electric power consumption of the blower motor, and the level of the noises being emitted increase superproportionally with increasing speed of rotation of the blower motor and hence of the delivery wheel, prior-art side channel blowers operate, especially when a vehicle heater is to be operated with a high heat output, not only comparatively uneconomically, but also with a comparatively high noise emission.

SUMMARY OF THE INVENTION

An object of the present invention is to provide a side channel blower, especially for a vehicle heater, which operates economically and with a low noise level even at a high required conveying output while having a compact design.

This object is accomplished according to the present invention by a side channel blower, especially for a vehicle heater, comprising

- a blower motor, in a blower housing, with a motor shaft that can be driven to rotate about an axis of rotation,
- a first blower housing area with a first delivery channel with a first delivering medium inlet and with a first delivering medium outlet, which said first delivery channel is open towards a first axial side and surrounds the axis of rotation in a ring-shaped manner,
- a first delivery wheel, which is located opposite the first axial side of the first housing area and covers the first delivery channel, wherein said first delivery wheel is carried at a first end area of the motor shaft,
- a second blower housing area with a second delivery channel with a second delivering medium inlet and with a second delivering medium outlet, which said second delivery channel is open towards a second axial side and surrounds the axis of rotation in a ring-shaped manner, and
- a second delivery wheel, which is located opposite the second axial side of the second blower housing area and covers the second delivery channel, wherein the second delivery wheel is carried at a second end area of the motor shaft.

Two delivery wheels acting in parallel to one another can be operated by a single blower motor in the side channel blower designed according to the present invention. Each of the delivery wheels delivers in the delivery operation a defined quantity of the medium to be delivered, i.e., for example, of the combustion air, for a vehicle heater, so that double the volume flow is obtained at a substantially lower speed of rotation of the delivery wheel compared to the operation of a single delivery wheel due to the addition of the two volume flows. This reduces the power drain of the blower as well as the noise emission.

To make it possible to couple the delivery wheels with the motor shaft for co-rotation in a simple manner with a simple design, it is proposed that the motor shaft pass through a first shaft exit opening with its first end area in the first blower housing area for coupling with the first delivery wheel and that the motor shaft pass with its second area through a second shaft exit opening in the second blower housing area for coupling with the second delivery wheel.

A compact design with very good utilization of the space available for installation can be obtained by the first axial side and the second axial side being oriented axially away from one another.

To accommodate the blower motor in the blower housing, it is proposed that a blower motor housing area be provided, wherein a stator and a rotor coupled with the motor shaft are arranged in the blower motor housing area.

A simple design embodiment with merging of the functions of the different housing areas can be achieved by a volume provided for mounting the motor, which is formed in the blower motor housing area, being axially limited by the first blower housing area or/and by the second blower housing area.

To make it possible to discharge the delivering medium being delivered by the two delivery wheels as a uniform flow of delivering medium from the blower housing, it is proposed that a delivering medium outlet space be formed in the blower housing, with the first delivering medium outlet and the second delivering medium outlet leading to the delivering medium outlet space.

Provisions may be made in an arrangement that is advantageous concerning the discharge of the volume flow of the medium to be delivered and also concerning the noise emission for the first delivering medium outlet and the second delivering medium outlet to be located opposite each other in the axial direction or/and to preferably essentially fully overlap each other in the radial direction or/and in the circumferential direction.

A uniform delivery characteristic of the two delivery areas, each comprising a delivery wheel and a delivery channel, can be supported by the first delivery channel and the second delivery channel being designed essentially mirror symmetrically in relation to one another relative to a symmetry plane extending at right angles to the axis of rotation. Provisions may, furthermore, be made for the first delivery wheel and the second delivery wheel to be designed essentially mirror symmetrically in relation to a symmetry plane extending essentially at right angles to the axis of rotation.

Provisions may, furthermore, be made in this above-mentioned mirror symmetrical design of the delivery channels and of the delivery wheels for the first delivery channel and the second delivery channel or/and the first delivery wheel and the second delivery wheel to be arranged without an angular offset in relation to one another. This means that while the design is basically the same and mirror symmetrical, the respective assembly units formed by the delivery channels and delivery wheels are also located relative to one another such that they are positioned fully congruently in the circumferential direction. This leads to an essentially symmetrical delivery characteristic of the two delivery areas.

It may be advantageous for minimizing the noises emitted by the blower if the first delivery channel and the second delivery channel or/and the first delivery wheel and the second delivery wheel are arranged with an angular offset in relation to one another. Consequently, the two blower areas do not operate here in phase in the rotary operation, so that it is possible to achieve a destructive interference by the phase-shifted noise emission.

The first delivery wheel may comprise a first delivery area surrounding the axis of rotation in a ring-shaped manner with a plurality of first delivery blades following each other in the circumferential direction. Likewise, the second delivery wheel may have a second delivery area surrounding the axis of rotation in a ring-shaped manner with a plurality of second delivery blades following each other in the circumferential direction.

To achieve the above-mentioned mirror symmetrical design of the two delivery wheels in this arrangement, it is proposed that an arrangement pattern of the first delivery blades correspond to an arrangement pattern of the second delivery blades. For example, the first delivery blades and the second delivery blades may be arranged at equal or equally varying circumferentially spaced locations from one another, which does not necessarily mean that the two delivery wheels must be carried on the motor shaft such that they are also located without angular offset in relation to one another if they have a basically identical or mirror symmetrical design.

The compact design of the side channel blower according to the present invention may, furthermore, be supported by a delivering medium inlet space being formed in the blower housing, with the first delivering medium inlet and the second delivering medium inlet leading away from the delivering medium inlet space.

The present invention will be explained in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
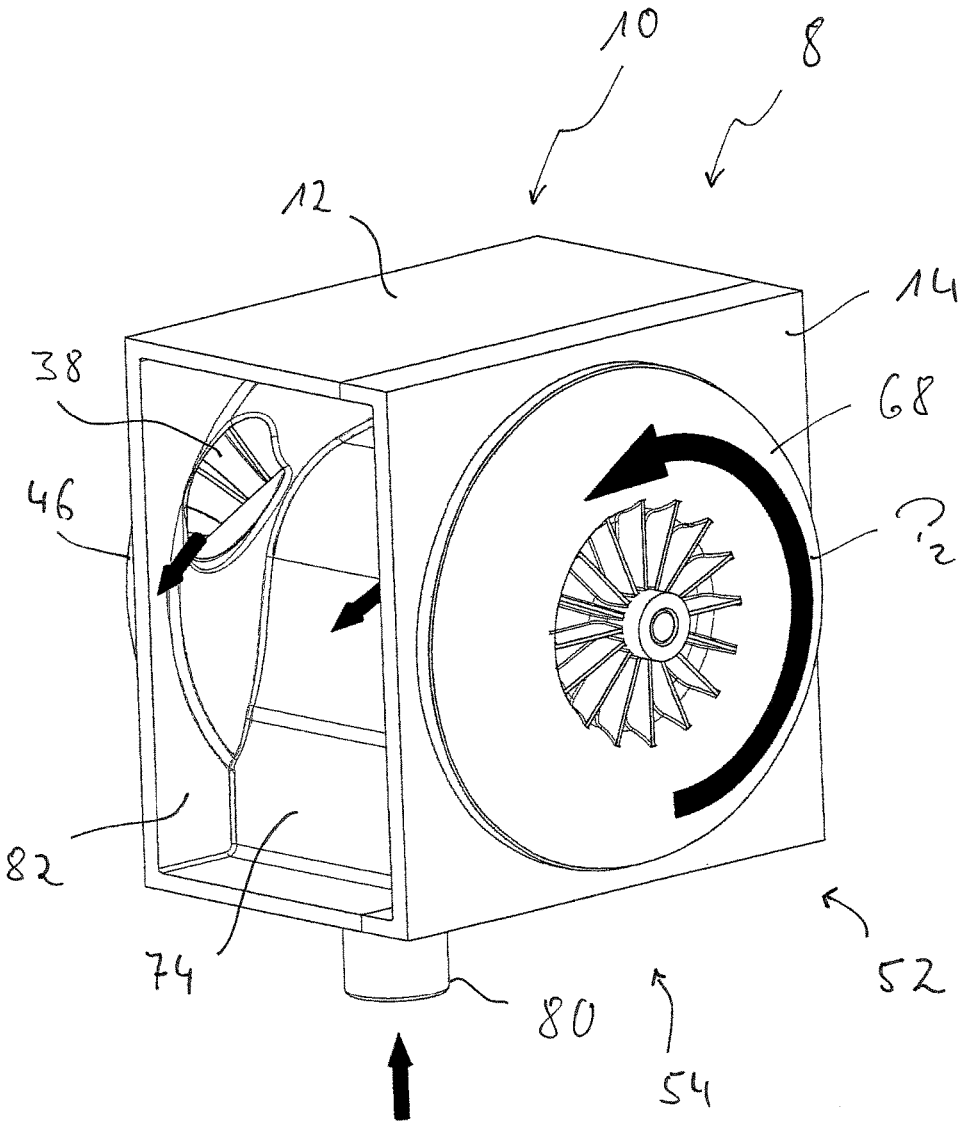
FIG. 1 is a perspective view of a side channel blower with two delivery wheels driven by a blower motor.

Referring to the drawings, a side channel blower is generally designated by 8 in FIG. 1. The side channel blower 8, which can be used, for example, to deliver combustion air to a fuel-operated vehicle heater, comprises a blower housing 10, which is provided with a first housing part 12 and a second housing part 14 in the example being shown. A blower motor, which can be energized electrically, is provided with a stator 18 and a rotor 22 coupled with a motor shaft 20 and is generally designated by 16, is provided in the blower housing 10. At the first housing part 12 as well as at the second housing part 14, a blower motor housing area 24 essentially accommodating the blower motor 16 comprises essentially regular cylindrical walls 26, 28 each, which are arranged essentially concentrically to an axis of rotation D of the blower motor 16 and together surround a motor installation volume of the blower housing 10 in the assembled state.

A first blower housing area 30 is provided at the first housing part 12. This blower housing area 30 comprises a first delivery channel 34 with a first delivering medium inlet 36 and with a first delivering medium outlet 38, said delivery channel 34 being open towards a first axial side 32 and surrounding the axis of rotation D in a ring-shaped manner. To avoid a flow short-circuit in the delivery channel 34, the first delivering medium inlet 36 and the first delivering medium outlet 38 are separated from one another by a first interruptor area 40.

A first end area 44 of the motor shaft 20 passes through a shaft exit opening 42 in the first blower housing area 30, so that a first delivery wheel 46 can be coupled, for example, by pressing on, with this first end area 44. The first delivery wheel 46 comprises, opposite the first delivery channel 34, a first delivery portion 48 with a plurality of first delivery blades 50 following each other in the circumferential direction. The first delivery wheel 46 rotates in a direction of rotation indicated by an arrow P1 about the axis of rotation D in the rotary operation and delivers as a result medium to be delivered, e.g., air, along the first delivery channel 34 from the first delivering medium inlet 36 to the first delivering medium outlet 38.

A second blower housing area 52 with a second delivery channel 56, which is open towards a second axial side 54 and surrounds the axis of rotation D in a ring-shaped manner, is provided at the second housing part 14. A second delivering medium inlet 58, a second delivering medium outlet 60 and a second interruptor area 62 located between them is associated with the second delivery channel 56. A second axial end area 64 of the motor shaft 20 passes through a second shaft exit opening 66 in the second blower housing area 52, so that a second delivery wheel 68 can be coupled with the motor shaft 20, for example, by being pressed onto the second end area 64 of said motor shaft 20, in such a way that it rotates in unison with said motor shaft 20. The second delivery wheel 68 comprises, axially opposite the second delivery channel 56, a second delivery portion 70 with a plurality of second delivery blades 72 following each other in the circumferential direction. Since the first delivery wheel 46 and the second delivery wheel 68 are coupled with the motor shaft 20 for co-rotation, the second delivery wheel 68 rotates in a direction of rotation indicated by the arrow P2 about the axis of rotation D, this direction of rotation corresponding to the direction of rotation of the first delivery wheel 46. Corresponding to the delivery action of the first delivery wheel 46, the second delivery wheel 68 also delivers air in the rotary operation from the second delivering medium inlet 58 to the second delivering medium outlet 60 along the second delivery channel 56.

Defined by two walls 74, 76, which may be formed partly at the first housing part 12 and partly at the second housing part 14, a delivering medium inlet space 78 is formed in the blower housing 10. An inlet opening 80, formed, e.g., in a connection piece, leads to the delivering medium inlet space 78. Furthermore, the two delivering medium inlets 36, 58 are open towards the delivering medium inlet space 78, so that the air entering the delivering medium inlet space 78 can flow into the first delivery channel 34 and the second delivery channel 56 via the delivering medium inlets 36, 58. Since the two walls 74, 76 are arranged such that the delivering medium inlet space 78 surrounds the walls 26, 28 that essentially form the blower motor housing area 24, heat generated in the area of the blower motor 16 during the delivery operation can be removed by the medium, air, which is flowing in the direction of the two delivery channels 34, 56.

Furthermore, a delivering medium outlet space 82, which is also defined essentially by the wall 74 and is delimited towards the delivering medium inlet space 78, is formed in the blower housing 10. This delivering medium outlet space 82 may be open on a side of the blower housing 10, on which side this blower housing 10 can be positioned adjoining a combustion chamber assembly unit of a vehicle heater. The two delivering medium outlets 38, 60 carry the medium being delivered, which is leaving the delivery channels 34, 56, into the delivering medium outlet space 82, from which a uniform, common flow of the delivering medium can then leave the blower housing 10.

Figure 2:
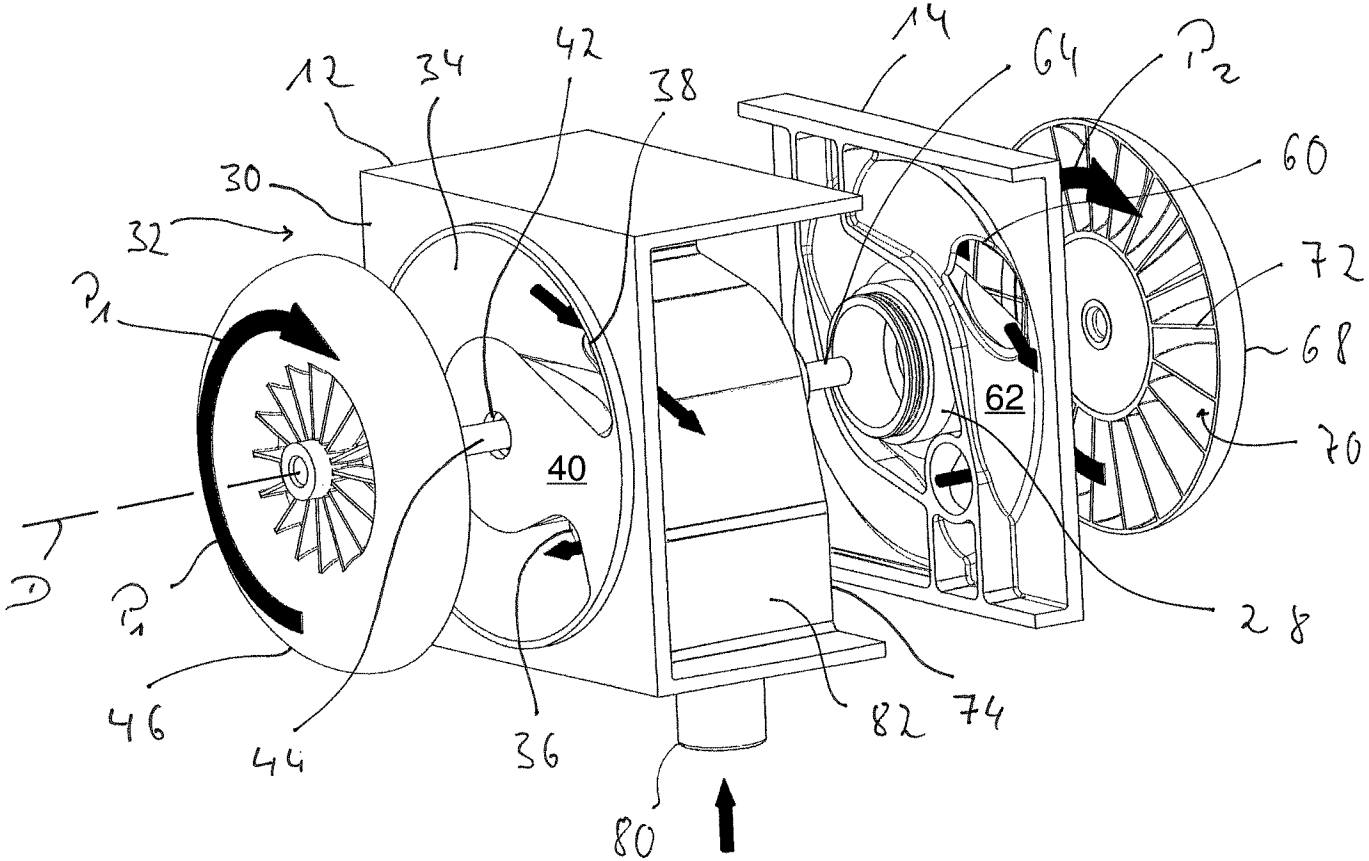
FIG. 2 is a perspective exploded view of the side channel blower according to FIG. 1.
Figure 3:
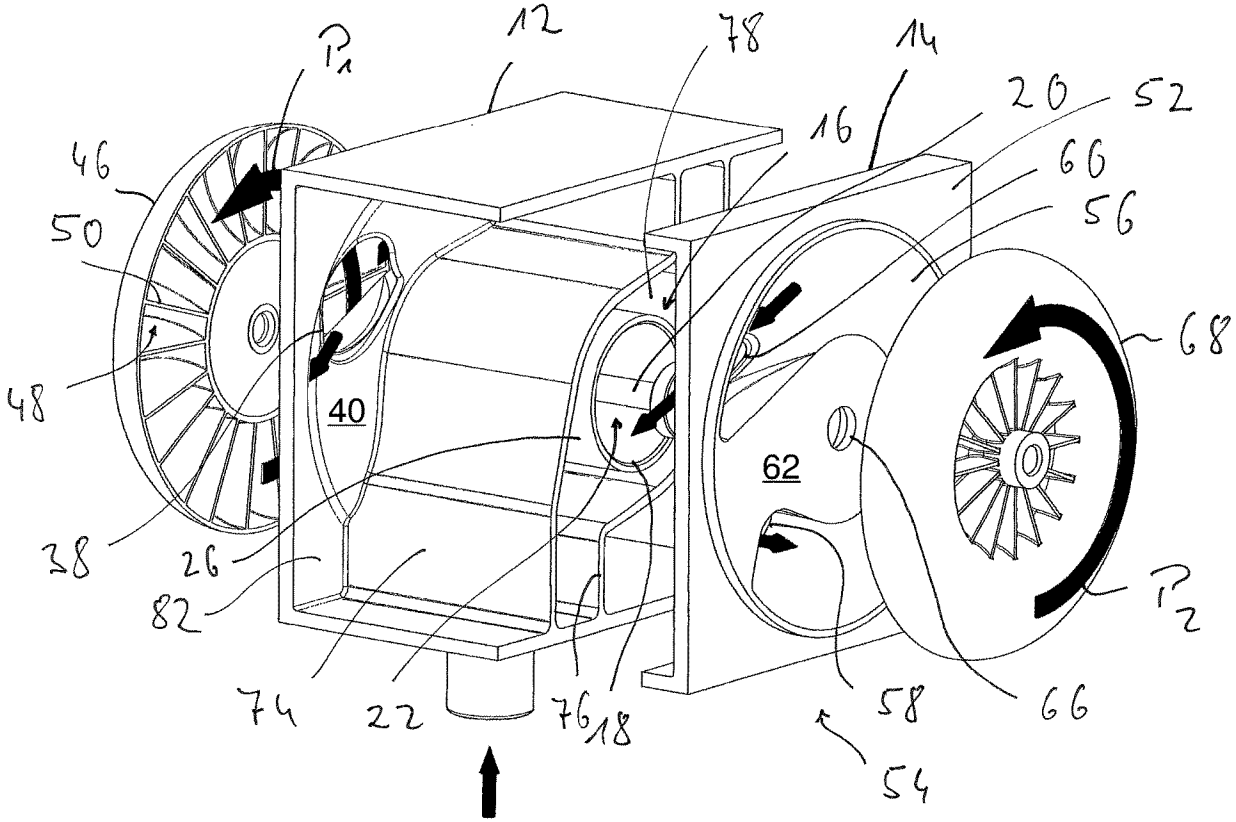
FIG. 3 is another perspective exploded view of the side channel blower according to FIG. 1.

It is seen in FIGS. 1 through 3 that the two delivery channels 34, 56, which are provided in the blower housing areas 30, 52 and are open on mutually opposite axial sides 32, 54, are of an essentially mirror symmetrical design in the embodiment being shown in relation to a symmetry plane that extends essentially at right angles to an axis of rotation D. Not only are these two delivery channels 34, 56 of a mirror symmetrical design, not only do they have a mirror-symmetrical geometric shape in relation to one another in the example being shown, but they are also positioned without an angular offset about the axis of rotation D in relation to one another, so that the two delivering medium outlets 38, 60 are positioned such that they fully overlap each other in the circumferential direction and in the radial direction and are therefore positioned mutually axially opposite each other. The generation of a uniform delivering medium flow from the blower housing 10 and the delivering medium outlet space 82 is thus supported.

The two delivery wheels 46, 68 may also be designed such that they have an essentially mutually mirror symmetrical shape especially in their delivery portion 48, 70. This means that the respective first and second delivery blades 50, 72 may be arranged in both delivery wheels 46, 68 with equal circumferential spacing or with equal variation of the circumferential spacing, for example, according to a pseudostatistical binary sequence. The two delivery wheels 46, 68, which thus have basically a mutually mirror symmetrical design, may be arranged on the common motor shaft 20 such that they are carried on the motor shaft 20 without angular offset, i.e., also with mirror symmetrical positioning. It is possible, as an alternative, to arrange the two delivery wheels 46, 68 with an angular offset in relation to one another, which may correspond, for example, to half of the angular offset or of the mean angular distance of the delivery blades 50, 72 immediately following one another. The development of constructive interferences in sound propagation can thus be avoided and noise minimization can be supported by the destructive superimposition.

By operating two delivery wheels with a single blower motor and by generating a common flow of the medium to be delivered, i.e., for example, the combustion air, which results from it, it becomes possible to attain comparatively high conveying outputs at a lower speed of rotation. Experiments have shown that nearly the same delivering medium flow can be attained with the design according to the present invention at a speed of rotation of 7,000 revolutions per minute as in a blower provided with a single delivery wheel at a speed of rotation of 10,000 revolutions per minute, always relative to the same counterpressure developing at a heater. The power drain of the blower or blower motor, which is associated with the third power of the speed of rotation, is also markedly reduced with this speed of rotation, which is markedly reduced for attaining a preset volume flow, and so is the sound pressure level.

While specific embodiments of the invention have been shown and described in detail to illustrate the application of the principles of the invention, it will be understood that the invention may be embodied otherwise without departing from such principles.

What is claimed is:

1. A vehicle heater side channel blower comprising:

a blower motor having a motor shaft that can be driven for rotation about an axis of rotation;

a blower housing, the blower motor being disposed in the blower housing, the blower housing comprising:

a first blower housing part with a first delivery channel with a first delivering medium inlet and with a first delivering medium outlet circumferentially separated from the first delivering medium inlet by a first interrupter portion, the first delivery channel being axially open towards a first axial side of the first blower housing part and having a partial ring-shape partially surrounding the axis of rotation;

a second blower housing part with a second delivery channel with a second delivering medium inlet and with a second delivering medium outlet circumferentially separated from the second delivering medium inlet by a second interrupter portion, the second delivery channel being axially open towards a second axial side of the second blower housing part oriented away from the first axial side of the first blower housing part and having a partial ring-shape partially surrounding the axis of rotation, the first and second delivering medium outlets being open towards a delivering medium outlet space formed in the blower housing for providing a common flow of delivering medium leaving the blower housing;

a first delivery wheel carried at a first end of the motor shaft and comprising a plurality of first delivery blades following each other in a circumferential direction in a ring shaped first delivery portion surrounding the axis of rotation and covering the first delivery channel; and a second delivery wheel carried at a second end of the motor shaft and comprising a plurality of second delivery blades following each other in a circumferential direction in a ring shaped second delivery portion surrounding the axis of rotation and covering the second delivery channel;

wherein the first delivery channel and the second delivery channel are designed with geometric shapes that are essentially mirror symmetrical relative to one another in relation to a symmetry plane that extends essentially at right angles to the axis of rotation;

wherein for providing an out of phase rotational operation, the first delivery channel and the second delivery channel are arranged with an angular offset about the axis of rotation relative to one another, the angular offset being configured for noise minimization by destructive superimposition.

2. A vehicle heater side channel blower in accordance with claim 1, wherein at least one of:

the first blower housing part has a first shaft exit opening and the motor shaft first end area passes through the first shaft exit opening in the first blower housing part for coupling with the first delivery wheel; and the second blower housing part has a second shaft exit opening and the motor shaft second end area passes through the second shaft exit opening in the second blower housing part for coupling with the second delivery wheel.

3. A vehicle heater side channel blower in accordance with claim 1, wherein:

the blower housing further comprises a blower motor housing;

the blower motor further comprises a stator and a rotor coupled with the motor shaft; and the stator and the rotor are arranged in the blower motor housing.

4. A vehicle heater side channel blower in accordance with claim 3, wherein the blower motor housing forms a motor accommodating volume that is axially defined by at least one of by the first blower housing part and by the second blower housing part.

5. A vehicle heater side channel blower in accordance with claim 1, wherein at least one of:

the first delivering medium outlet and the second delivering medium outlet are located opposite each other in the axial direction; and the first delivering medium outlet and the second delivering medium outlet essentially fully overlap each other in the radial direction; and the first delivering medium outlet and the second delivering medium outlet essentially fully overlap each other in the circumferential direction.

6. A vehicle heater side channel blower in accordance with claim 1, wherein the first delivery wheel and the second delivery wheel are designed with geometric shapes that are essentially mirror symmetrically in relation to a symmetry plane extending essentially at right angles to the axis of rotation.

7. A vehicle heater side channel blower in accordance with claim 6, wherein the first delivery wheel and the second delivery wheel are arranged without an angular offset about the axis of rotation relative to one another.

8. A vehicle heater side channel blower in accordance with claim 6, wherein the first delivery wheel and the second delivery wheel are arranged with an angular offset about the axis of rotation relative to one another.

9. A vehicle heater side channel blower in accordance with claim 1, wherein an arrangement pattern of the first delivery blades corresponds to an arrangement pattern of the second delivery blades.

10. A vehicle heater side channel blower in accordance with claim 1, wherein:

a delivering medium inlet space is formed in the blower housing; and the first delivering medium inlet and the second delivering medium inlet lead away from the delivering medium inlet space.

11. A vehicle heater side channel blower in accordance with claim 1, wherein:

the angular offset is configured to achieve destructive interference by phase-shifted noise emission.

12. A vehicle heater side channel blower comprising:

a blower motor having a motor shaft that can be driven for rotation about an axis of rotation;

a blower housing, the blower motor being disposed in the blower housing, the blower housing comprising:

a first blower housing part with a first delivery channel with a first delivering medium inlet and with a first delivering medium outlet circumferentially separated from the first delivering medium inlet by a first interrupter portion, the first delivery channel being axially open towards a first axial side of the first blower housing part and having a partial ring-shape partially surrounding the axis of rotation;

a second blower housing part with a second delivery channel with a second delivering medium inlet and with a second delivering medium outlet circumferentially separated from the second delivering medium inlet by a second interrupter portion, the second delivery channel being axially open towards a second axial side of the second blower housing part oriented away from the first axial side of the first blower housing part and having a partial ring-shape partially surrounding the axis of rotation, the first and second delivering medium outlets being open towards a delivering medium outlet space formed in the blower housing for providing a common flow of delivering medium leaving the blower housing;

a first delivery wheel carried at a first end of the motor shaft and comprising a plurality of first delivery blades following each other in a circumferential direction in a ring shaped first delivery portion surrounding the axis of rotation and covering the first delivery channel; and a second delivery wheel carried at a second end of the motor shaft and comprising a plurality of second delivery blades following each other in a circumferential direction in a ring shaped second delivery portion surrounding the axis of rotation and covering the second delivery channel;

wherein the first delivery channel and the second delivery channel are designed with geometric shapes that are essentially mirror symmetrical relative to one another in relation to a symmetry plane that extends essentially at right angles to the axis of rotation;

wherein for providing an out of phase rotational operation, the first delivery channel and the second delivery channel are arranged with an angular offset about the axis of rotation relative to one another, the angular offset being configured to half of an angular distance of the delivery blades.

13. A vehicle heater side channel blower in accordance with claim 12, wherein:

the angular offset is configured for noise minimization by destructive superimposition.

* * * * *